US009175518B2

(12) United States Patent
Kotsonis et al.

(10) Patent No.: US 9,175,518 B2
(45) Date of Patent: Nov. 3, 2015

(54) ANCHORING SYSTEMS FOR DRILLING TOOLS

(75) Inventors: Spyro Kotsonis, Missouri City, TX (US); Eric Lavrut, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 844 days.

(21) Appl. No.: 12/742,452

(22) PCT Filed: Nov. 6, 2008

(86) PCT No.: PCT/EP2008/009608

§ 371 (c)(1),
(2), (4) Date: Dec. 13, 2010

(87) PCT Pub. No.: WO2009/062718

PCT Pub. Date: May 22, 2009

(65) Prior Publication Data

US 2011/0277990 A1 Nov. 17, 2011

(30) Foreign Application Priority Data

Nov. 15, 2007 (GB) ..... 0722441.3

(51) Int. Cl.

| | |
|---|---|
| ***E21B 4/18*** | (2006.01) |
| ***E21B 23/01*** | (2006.01) |
| ***E21B 23/04*** | (2006.01) |
| *E21B 23/00* | (2006.01) |

(52) U.S. Cl.

CPC . *E21B 4/18* (2013.01); *E21B 23/01* (2013.01); *E21B 23/04* (2013.01); *E21B 2023/008* (2013.01)

(58) Field of Classification Search

USPC ..... 166/120, 134, 206, 212, 213, 381, 217; 175/98, 99, 325.1, 76, 73, 250, 61

See application file for complete search history.

(56) References Cited

U.S. PATENT DOCUMENTS

| | | | | |
|---|---|---|---|---|
| 2,612,346 | A * | 9/1952 | Nelson | 175/77 |
| 2,874,783 | A | 2/1959 | Haines | |
| 4,314,615 | A | 2/1982 | Sodder, Jr. et al. | |
| 5,794,703 | A | 8/1998 | Newman et al. | |
| 5,954,131 | A | 9/1999 | Sallwasser | |
| 6,003,606 | A | 12/1999 | Moore et al. | |
| 6,026,911 | A * | 2/2000 | Angle et al. | 175/24 |
| 6,142,235 | A | 11/2000 | Monjure et al. | |
| 6,179,055 | B1 | 1/2001 | Sallwasser et al. | |

(Continued)

FOREIGN PATENT DOCUMENTS

| | | | |
|---|---|---|---|
| EP | 04292251.8 | * 9/2005 | E21B 4/18 |
| EP | 1845230 | 10/2007 | |

(Continued)

*Primary Examiner* — Kenneth L Thompson
*Assistant Examiner* — Ronald Runyan
(74) *Attorney, Agent, or Firm* — Stephanie Chi; Jody DeStefanis

(57) ABSTRACT

An anchoring system for a tool in a borehole is provided. The anchoring system comprising a tool body, anchoring members which are operable to extend from the tool body so as to deploy an anchor portion into contact with the borehole wall such that when deployed. The anchoring members act to support the tool body in a central region of the borehole. Moreover, the anchoring members are connected to an operating mechanism which links deployment of the anchoring members so as to distribute the anchoring force and position of the anchoring members in a controlled manner.

5 Claims, 3 Drawing Sheets

(56) References Cited

U.S. PATENT DOCUMENTS

| | | | | |
|---|---|---|---|---|
| 6,230,813 | B1 * | 5/2001 | Moore et al. | 166/381 |
| 6,629,568 | B2 | 10/2003 | Post et al. | |
| 6,629,570 | B1 | 10/2003 | Head | |
| 6,651,747 | B2 | 11/2003 | Chen et al. | |
| 6,655,458 | B2 | 12/2003 | Kurkjian et al. | |
| 6,772,839 | B1 | 8/2004 | Bond | |
| 7,287,605 | B2 * | 10/2007 | Van Steenwyk et al. | 175/61 |
| 2004/0026128 | A1 * | 2/2004 | Krueger et al. | 175/76 |
| 2004/0055788 | A1 | 3/2004 | Best | |
| 2005/0082055 | A1 | 4/2005 | Bloom et al. | |
| 2005/0145415 | A1 | 7/2005 | Doering et al. | |
| 2006/0180318 | A1 | 8/2006 | Doering et al. | |
| 2007/0181298 | A1 | 8/2007 | Sheiretov | |
| 2008/0156487 | A1 * | 7/2008 | Zazovsky et al. | 166/264 |

FOREIGN PATENT DOCUMENTS

| | | | |
|---|---|---|---|
| EP | 1344893 | | 10/2009 |
| GB | 2388132 | A | 11/2003 |
| GB | 2398308 | A | 8/2004 |
| WO | 9726436 | | 7/1997 |
| WO | 2006125373 | | 11/2006 |
| WO | 2007091218 | | 8/2007 |

* cited by examiner

ANCHORING SYSTEMS FOR DRILLING TOOLS

CROSS-REFERENCE TO RELATED APPLICATIONS

The present application is based on and claims priority to GB Application No. 0722441.3, filed 15 Nov. 2007; and International Patent Application No. PCT/EP2008/009608, filed 6 Nov. 2008. The entire contents of each are herein incorporated by reference.

TECHNICAL FIELD

This invention relates to anchoring systems for use with drilling tools. In particular, the invention relates to anchoring systems for use with drilling tools that cannot rely on drill pipe for weight on bit and which generate rotation downhole.

BACKGROUND ART

In a conventional drilling setup, a drill bit is mounted on a bottom hole assembly (BHA) that is connected to a drill string made up of tubular members connected in an end-to-end arrangement. The BHA can include measuring instruments, a drilling motor, telemetry systems and generators. Penetration is achieved by rotating the drill bit while applying weight on bit (WOB). Rotation can be achieved by rotating the drill string at the surface or by use of a drilling motor downhole on which the drill bit is mounted. The drilling motor is typically powered by flow of a drilling fluid through the drill string and into a hydraulic motor in the BHA. The drilling fluid exits through the drill bit and returns to the surface outside the drill string carrying drilled cuttings with it. WOB is applied by the use of heavyweight drill pipe in the drill string above the BHA.

Clearly WOB can only be applied when the heavyweight drill pipe is close to vertical in the borehole. When it is desired to drill highly deviated borehole sections (close to horizontal), the heavyweight drill pipe may have to be located some distance from the BHA in order for it to be in a borehole section that is close to vertical.

Another form of drilling uses coiled tubing to connect the BHA to the surface. An example of this is found in Hill D, Nerne E, Ehlig-Economides C and Mollinedo M "Reentry Drilling Gives New Life to Aging Fields" Oilfield Review (Autumn 1996) 4-14 which describes the VIPER Coiled Tubing Drilling System. In this case the coiled tubing is used to push the drilling tool along the well and provide WOB. However, problems can occur as the coiled tubing does not have great strength in compression.

Recently, various proposals have been made for drilling systems conveyed on wireline cable. An example of this is found in GB2398308. Clearly a flexible cable cannot be used to provide WOB.

The various problems incurred in obtaining WOB, in conventional, coiled tubing and wireline drilling have lead to the development of tractor or thruster devices to provide the necessary WOB. These devices typically lock in the borehole above the drill bit to provide a reaction point and use a drive mechanism to urge the drill bit away from the reaction point and provide WOB.

There have been a number of proposals for tractors and thrusters. Tractors are used to convey borehole tools along the borehole in highly deviated situations. These typically pull the tool(s) on a wireline cable down the well which is then logged back up the well on the wireline cable pulled from the surface. Examples of tractors for such uses can be found in U.S. Pat. No. 5,954,131, U.S. Pat. No. 6,179,055 and U.S. Pat. No. 6,629,568. A tractor for use with coiled tubing or drill pipe is described in U.S. Pat. No. 5,794,703 or U.S. Pat. No. 6,142,235.

Rather than pulling the tool, a thruster pushes a tool forward. Examples of such thrusters can be found in U.S. Pat. No. 6,003,606, U.S. Pat. No. 6,230,813, U.S. Pat. No. 6,629,570 and GB 2 388 132. Thrusters often can be used for pulling as well. The term "tractor" is used in this application to indicate both forms of device. Where a distinction is required, the terms "pulling tractor" and "pushing tractor" are used.

Other examples of downhole anchoring in tools can be found in U.S. Pat. No. 6,651,747 and U.S. Pat. No. 6,655,458.

There are various mechanisms used by tractors. In one approach, wheels or chains act on the borehole wall to drive the tractor along. Another approach is a push-pull crawler. In this case, the device locks one end against the borehole wall and extends a free end forward. At the limit of its extent, the free end is then locked and the other end released and retracted to the newly locked end. When fully retracted, the other end is locked and the locked end released and advanced again. This is repeated as required to either push or pull equipment connected to the tractor. This can be used for both pushing and pulling actions.

When drilling wells using a wireline drilling system, the tractor may encounter many situations where a classic piston anchoring system will not be adequate. These can include washouts, cave-ins, and very soft formations in open-hole. In cased-hole, during trips; the tractor can encounter obstructions from completion equipment, and weak tubing. Furthermore, the same tractor may need to be sufficiently multifunctional to be able to operate in open hole, tubing, and casing, in various aging conditions (erosion, corrosion, etc).

It is an object of this invention to provide anchoring techniques that can be used by tractors in various hole and casing situations.

DISCLOSURE OF INVENTION

A first aspect of the invention provides an anchoring system for a tool in a borehole, comprising:

a tool body;

at least two anchoring members which are operable to extend from the tool body so as to deploy an anchor portion into contact with the borehole wall such that when deployed, the anchoring members act to support the tool body in a central region of the borehole;

wherein the anchoring members are connected to an operating mechanism which links deployment of the anchoring members so as to distribute the anchoring force and position of the anchoring members in a controlled manner.

In one embodiment, the operating mechanism comprises a double acting drive mechanism operable to positively extend and retract each anchoring member.

In one embodiment, the double acting drive mechanism is a pinion drive which engages one or more anchoring members. In a particularly preferred embodiment, a single pinion drive acts on two or more anchoring members.

In another embodiment, the anchoring members comprise pistons in cylinders, separate fluid supplies being provided to extend or retract each anchoring member. In one example, a mechanical linkage is provided between anchoring members to link extension or retraction under the influence of the fluid supplies. In another, separate extension and retraction supplies are provided for each piston.

In a particularly preferred configuration, pairs of anchoring members are provided, the members of each pair being spaced apart in an axial direction of the tool body. A contact member can be provided which bridges the two members of each pair and engages the borehole when deployed. In one embodiment, the contact member is a skid. In another embodiment, the contact member comprises a resilient bow which is connected to the tool body on either side of the pair of anchoring members.

Preferably, the anchoring portion comprises a one-way locking member arranged such that axial movement of the tool body in one direction in the borehole increases the anchoring force and in the opposite direction decreases the anchoring force. The one way locking member can comprise an anchor plate which is mounted on the anchoring member by means of pegs engaging in angled slots such that, when deployed, movement of the tool causes the pegs to move in the slots to increase or decrease the anchoring force.

In another aspect of the invention, an anchoring system comprises two or more modules, each of which comprises a system according to the first aspect of the invention. Each module can be separately operable. It is particularly preferred that at least one module can remain inoperable while others are operated to provide the required anchoring effect.

A further aspect of the invention comprises a bottom hole assembly for a borehole drilling tool, comprising a pair of such anchoring systems separated by an axial drive that can be operated to extend or contract in an axial direction between the two anchoring systems. Such a system can act as a tractor-type drive system for a downhole drilling tool.

Further aspects of the invention will be apparent from the detailed description below.

BRIEF DESCRIPTION OF FIGURES IN THE DRAWINGS

MODES(S) FOR CARRYING OUT THE INVENTION

Drilling boreholes using a system such as that described in GB2398308 that has a wireline cable extending from the bottom-hole drilling assembly (BHA) to the surface offers many benefits in terms of reduction of cost-of-drilling, and reduction of assets and personnel on location. However, with these comes a reduction in the available power available to drill with. Wireline drilling tools of the type to which this invention particularly applies may have operational requirements to be able to kick-off from a parent well and turn at a very aggressive turn rate (up to 120°/100 ft, or a 15 m radius), and then steer using very small doglegs to target depth. Since the conditions under which the tool must advance can vary considerably (small tubing, large casing, or open hole), various anchoring mechanisms may be required.

The invention provides techniques that address multiple issues that may be encountered when drilling a lateral hole. Some of these are general (standard and wireline drilling situations), while others are specific to drilling with a wireline tool.

One of the issues encountered is that of a washed-out hole, or a cave-in, that would prevent the anchoring of a wireline crawler/tractor from being able to make good contact with the formation. There is also the possibility that the formation might not be strong enough to provide sufficient anchoring reaction to pull the tools and wireline cable along the borehole while drilling (or while tripping). Finally, the condition of the tubing may have changed with time (due to corrosion or erosion for example), forcing the anchor to apply a lower anchoring force, or to further spread the contact area.

There is also the issue of getting around obstacles in the production tubing or the casing (plus the transition zone at the window.) Obstacles can be downhole valves or other completion string components.

The crawler/tractor referred to here is based on the one described in GB2398308. In its simplest form, it contains a lower and upper anchor and an axial piston, To travel, it sequentially activates the anchors and the axial piston to anchor and advance. The anchors can comprise pairs of pistons aligned axially on the tool. The pistons can be hydraulically driven to come into contact with the formation and lock the anchor in place. A limitation of this method is that the pressure against the formation or the tubing (at the pistons) can be very localized and large, and can potentially lead to puncturing holes in the tubing or breaking the formation. Additionally, when it is time to retrieve the pistons, they must be almost completely retracted before moving, so as to avoid snagging on restrictions and ledges (such as tubing transitions, or the window.)

Figure 1:
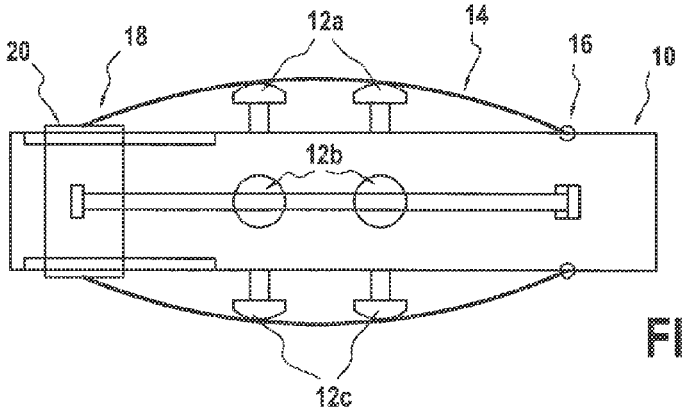
FIG. 1 shows a first embodiment of the invention.

One embodiment of the invention (as shown in FIG. 1) involve pistons that can be hydraulically driven and metal bows that are used to increase the contact area with the formation, and decrease the likelihood of snagging on upsets in the tubing/casing. The tool shown in FIG. 1 comprises a tool body 10 having pairs of pistons 12*a*, 12*b*, 12*c*. At least two pairs of pistons must be provided but three or four pairs disposed equiangularly around the tool body 10 may be more effective. The tool body also includes a piston actuating mechanism, for example a hydraulic system for extending or retracting the pistons (not shown). Each pair of pistons 12 has an associated metal bow spring 14 connected to the tool body 10 and extending over the tops of the piston 12. One end 16 of each spring 14 is connected to the tool body 10 by a hinge (or other pivot or flexible connection). The other end 18 is similarly connected to a collar 20 that is slidably mounted around the tool body on the opposite sides of the pistons 12.

In use, the pistons 12 are extended from the body and bear on the springs 14, distorting them outwards until they contact the borehole wall. The springs act to spread the anchoring force from the two pistons in each pair across a greater areas and so reduce the problems mentioned above. The presence of the spring 14 providing a smooth outer surfaces also does not require the pistons to be fully retracted before advancement of the tool in the borehole.

Figure 2:
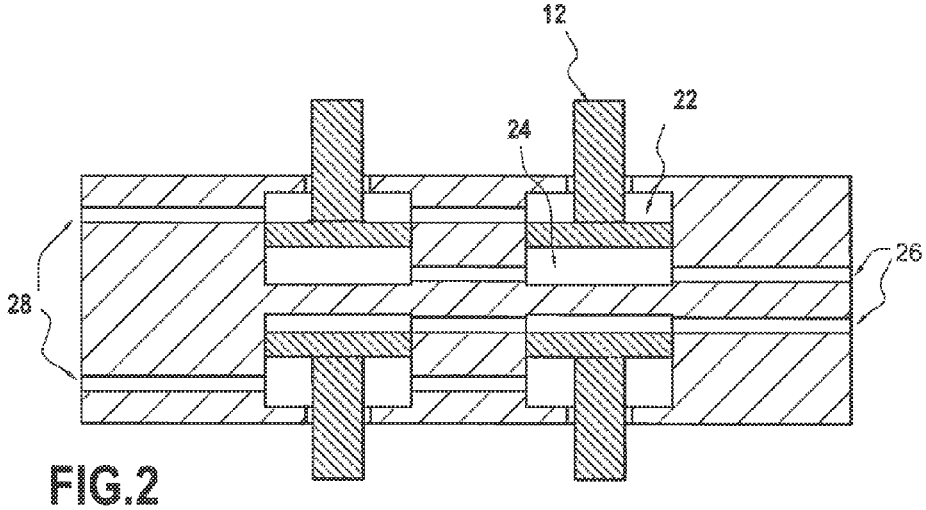
FIG. 2 shows details of piston drive of FIG. 1.
Figure 3:
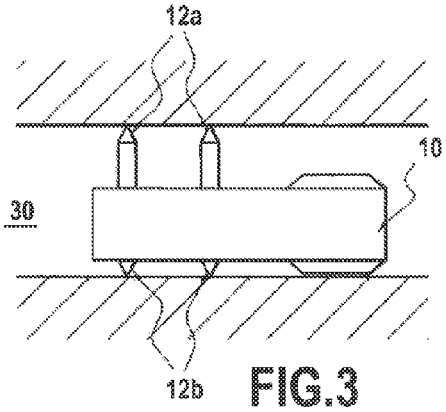
FIG. 3 shows the embodiment of FIG. 1 in a borehole.
Figure 4:
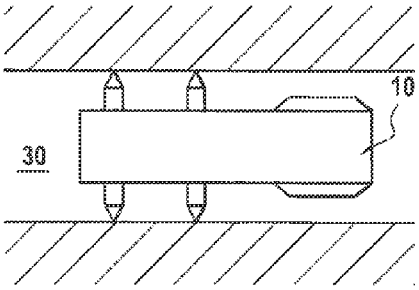
FIG. 4 shows a second embodiment in a borehole.

The pistons can be hydraulically driven as shown in FIG. 2. Each piston 12 is driven by a double acting piston 22 in a hydraulic cylinder 24 which is connected to two, independently operable hydraulic fluid supplies, one of which 26 admits fluid below the double acting pistons 22 to extend the pistons 12, and the other 28 which admits fluid above the double acting pistons 22 to retract the pistons 12. The lower and upper parts of each cylinder 24 of a pair of pistons 12 are connected so that a single connection to the respective fluid supply 26, 28 is needed.

Where the pistons are all pressurized by the same hydraulic system 26 to extend the pistons, the tool weight will tend to cause the tool 10 to lie on the low side of the borehole 30 as is shown in FIG. 3. The preferred case is a system that can lift the tool 10 to the centre of the borehole 30 and then lock it in position as is shown in FIG. 4. This can be done by using separate pistons, or by mechanically linking the pistons.

Figure 5:
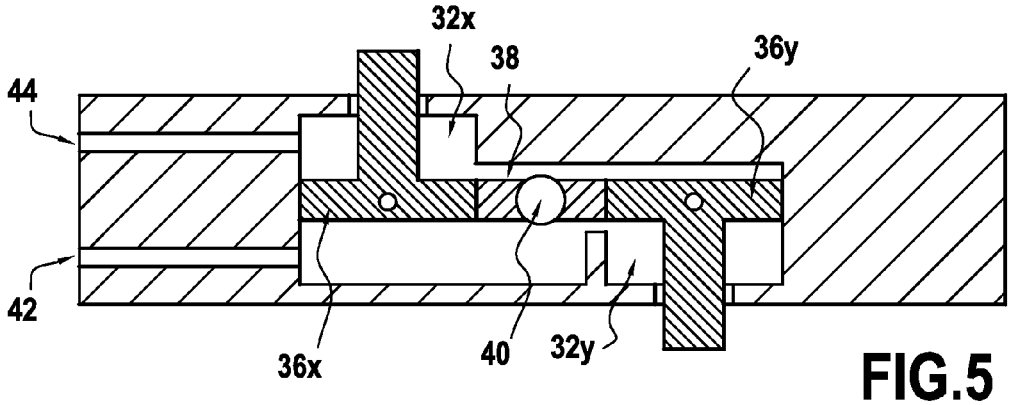
FIG. 5 shows a first mechanism for use in the embodiment of FIG. 4.

FIG. 5 shows one approach to linking operation of the pistons to control their action. Again, a double acting piston and cylinder arrangement is used. However, in this case, while the upper parts 32*x*, 32*y* of each opposing cylinder are separate, the lower parts are joined to a common manifold 34. The double acting pistons 36*x*, 36*y* are mechanically connected by a rocker arm 38 which is pivotally mounted 40 in the common manifold 34. Separate extend and retract fluid supplies 42, 44 are provided as before. This mechanical connection constrains the opposing pistons 36*x*, 36*y* to synchronise their movements such that each one moves the same distance as the other. The effect of this is that extension of the pistons operates to lift the tool to the centre of the borehole.

Figure 6:
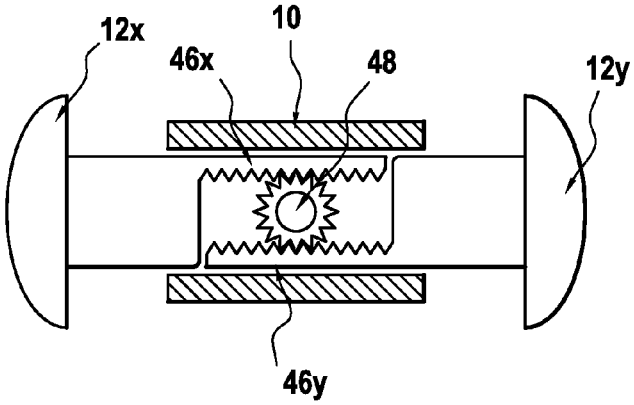
FIG. 6 shows a second mechanism for use in the embodiment of FIG. 4.

Another embodiment which provides synchronized activation of the pistons is shown in FIG. 6. In this case, both the actuation and synchronisation of the pistons is achieved by a mechanical drive. Instead of the hydraulic piston and cylinder arrangement described before, the pistons 12 are provided with an extension on which a rack 46 is formed. The rack 46 engages with a pinion gear drive 48 (connected to a motor, not shown). Rotation of the pinion gear 48 by the motor acts on the rack 46 to extend or retract the piston 12. By arranging opposed pistons 12*x*, 12*y* such that the racks 46*x*, 46*y* are on opposite sides of the pinion gear 48, operation of the pinion drive will move both pistons 12*x*, 12*y* by the same amount (assuming that the racks have the same dimensions). Other such mechanical systems can also be used, e.g. worm and gear.

Figure 7:
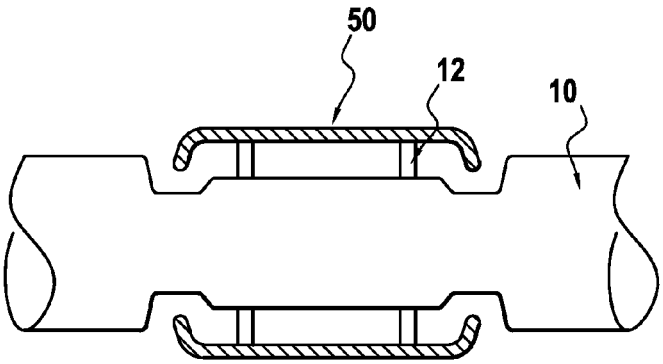
FIG. 7 shows an alternative embodiment of the invention.

Instead of using the metal bows as described above in relation to FIG. 1 to assure a smooth external contact with the formation, each pair of pistons 12 can be attached to a skid 50 as is shown in FIG. 7, thus decreasing the overall length of the assembly. Also, separate control of the motion of each anchor piston can be used to obtain more accurate positioning in an irregular borehole.

Figure 8:
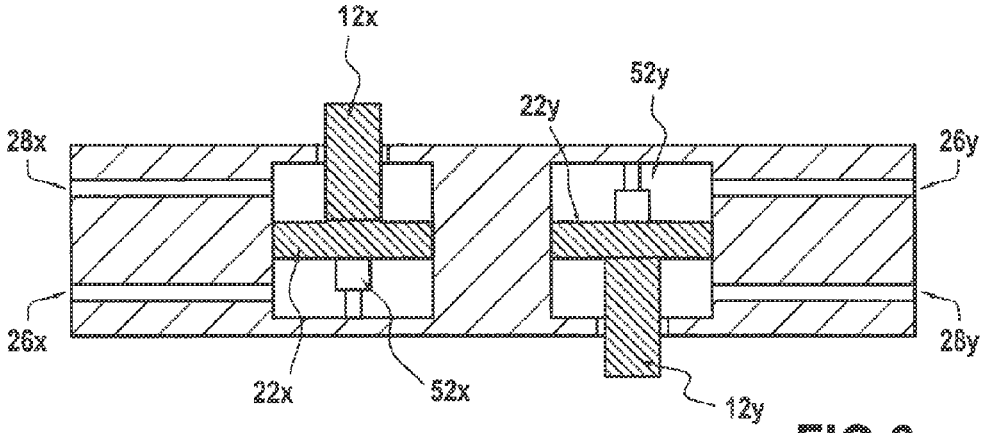
FIG. 8 shows a variant of FIG. 2.

A variant of the embodiment of the invention shown in FIG. 2 involves individual control of the pistons as is shown in FIG. 8. In this case, each piston 12*x*, 12*y* is provided with its own associated fluid supplies 26*x*, 28*x*, and 26*y*, 28*y*, so that each can be operated independently of the other. Each piston is also provided with an associated position sensor 52*x*, 52*y* by which the position can be measured. Feeding the output of the positions sensors 52 back to the control system allows for the selection of any position within the hole, not just centralised.

Figure 9:
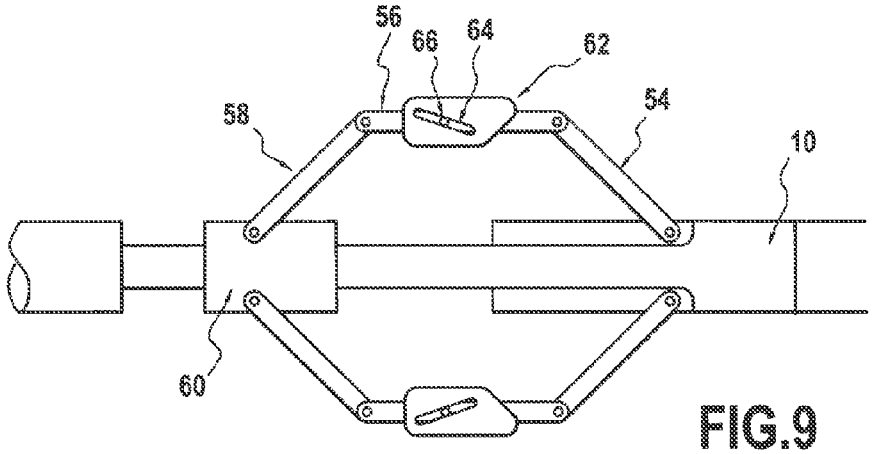
FIG. 9 shows another embodiment of an anchoring system.

Another anchoring method is shown in FIG. 9. In this case, the pistons are replaced by an articulated link arrangement. This comprises a first link member 54 that is pivotally connected at tone end to the tool body 10 and to one end of a pad 56 a the other end. A second link member 58 is pivotally connected at one end to a sliding sleeve 60 mounted on the tool body 10, and to the other end of the pad 56. Sliding the sleeve axially on the tool body 10 extends or retracts the pad 56 for contact with the borehole wall. A drawback of this method is that the anchoring force that can be applied is relatively small. This approach can be further improved by adding a one-way locking mechanism comprising a locking shoe 62 that is mounted on the pad 56. The shoe 62 has angled slots 64 which engage on pegs 66 on the pad 56 such that where once the pads have come into contact with the formation, the actuating mechanism is locked and any axial movement tends to further lock the anchor in place.

This locking mechanism can be used on the hydraulic or mechanical piston embodiments described above to further increase the holding force.

One preferred embodiment of an anchor for a wireline drilling tool of the type shown in FIG. 7 comprises three skids (at 120°), each on individually controlled and measured hydraulic. This allows for precise and controlled positioning of the tool in the hole (in tubing, casing, and in open-hole). The skids can include a locking mechanism of the type described above in relation to FIG. 9, so as to lock in forward motion (to apply the maximum possible force when pulling the tool and cable/circulation fluid conduit). One hydraulic block (motor/hydraulic pump) can be used to drive all three skids using a multiple-way solenoid block that can divert the hydraulic fluid to the desired skid. Linear displacement transducers can be used as sensors to detect the extension of the skids, which can both place the tool appropriately in the hole, but also be used to determine the diameter of the hole (and eventual out-of-roundness) at that location.

Anchors can be used to lock the tool in position during drilling, and for crawling in and out of the wellbore, but they can also be used to preferentially push the bit to one side during drilling. Multiple anchor modules can be used to decrease the risk of getting stuck. Each anchor module comprises a set of anchoring members and an actuating system (e.g. opposed pistons, skids, etc. and a hydraulic system or motor). If one of the anchor modules required for the next stroking action happens to be in a washed-out (or too weak formation) area, then another module further up the tool could be activated to proceed with the advancement. This further anchor module would be employed for multiple strokes until the initial anchor has steady footing again. These modular anchors can also help push and pull the tool through the transition zone at the window (between the casing/tubing and the open hole curve.)

Figure 10:
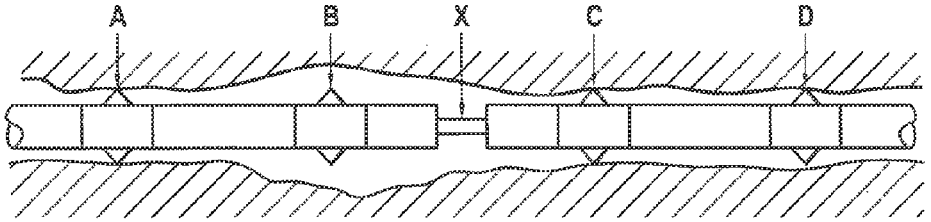
FIG. 10 shows operation of a yet further embodiment in an over gauge borehole.

A wireline drilling tool BHA tractor must use a minimum of one axial piston and two anchors (one on either side of the axial piston). However, a multi-anchor BHA could have the configuration shown in FIG. 10 comprising two anchor modules A, B, C, D on either side of an axial drive piston X. If anchor B is in an over-gauge section, anchor A can be activated to proceed with advancement and drilling. Once anchor A arrives at the over-gauge section, then anchor B would be used again. Modular anchors would also increase the pulling capacity, since both anchors could be activated (e.g. C and D) to provide more anchoring force.

Further changes are possible within the scope of the invention.

The invention claimed is:

1. An anchoring system for a tool in a borehole, comprising:

a tool body;

at least two anchoring members which are operable to extend from the tool body so as to deploy an anchor portion towards a wall defining the borehole and retract towards the tool body and away from the wall, wherein the at least two anchoring members comprise a first anchoring member and a second anchoring member, each anchoring member comprising a piston movable within a hydraulic chamber, wherein the piston separates the hydraulic chamber into a first portion of the chamber and a second portion of the chamber;

a first extension fluid supply connected to a first portion of the chamber of the first anchoring member;

a first retraction fluid supply connected to a second portion of the chamber of the first anchoring member;

a second extension fluid supply connected to a first portion of the chamber of the second anchoring member;

a second retraction fluid supply connected to a second portion of the chamber of the second anchoring member, wherein each of the first extension fluid supply, the first retraction fluid supply, the second extension fluid supply, and the second retraction fluid supply are separately supplied;

an operating mechanism coupled to the at least two anchoring members, wherein the operating mechanism is configured to control the extension of the at least two anchoring members by providing fluid through the extension fluid supply into the first portion of the chamber and control the retraction of the at least two anchoring members by providing fluid through the retraction fluid supply into the second portion of the chamber; and a position sensor coupled to each piston of each of the at least two anchoring members, wherein the position sensor is configured to measure a position of an associated piston or an associated anchoring member and communicate the position; and wherein the operating mechanism is configured to separately control the extension fluid supply and retraction fluid supply of each of the at least two anchoring members to position the anchoring members in a fully extended position, a fully retracted position, and a position between the fully extended position and the fully retracted position, based on the position measured by the position sensor, wherein the operating mechanism is configured to separately control the position of the first anchoring member and the position of the second anchoring member.

2. The system as claimed in claim 1, wherein separate extension and retraction supplies are provided to each hydraulic chamber of each respective piston of the at least two anchoring members.

3. The system as claimed in claim 1, wherein pairs of anchoring members are provided, the anchoring members of each pair being spaced apart in an axial direction of the tool body.

4. The system as claimed in claim 3, wherein a contact member is provided which bridges the two anchoring members of each pair and engages the borehole when deployed.

5. The system as claimed in claim 4, wherein the contact member is a skid or a resilient bow which is connected to the tool body through the pair of anchoring members.

* * * * *